US006315337B1

(12) United States Patent
Lewis

(10) Patent No.: US 6,315,337 B1
(45) Date of Patent: Nov. 13, 2001

(54) GLASP

(76) Inventor: Bertram Fritz Albert Lewis, 1500 Church Rd., Wyncote, PA (US) 19095

( * ) Notice: Subject to any disclaimer, the term of this patent is extended or adjusted under 35 U.S.C. 154(b) by 0 days.

(21) Appl. No.: 09/089,679

(22) Filed: Jun. 3, 1998

(51) Int. Cl.[7] ..... E05C 19/08
(52) U.S. Cl. ..... 292/285; 292/281; 292/DIG. 21
(58) Field of Search ..... 292/281–287, 292/DIG. 21

(56) References Cited

U.S. PATENT DOCUMENTS

| | | | | |
|---|---|---|---|---|
| 311,934 | * | 2/1885 | Williams | 292/281 |
| 1,336,505 | * | 4/1920 | Buggeln | 292/281 |
| 1,377,426 | * | 5/1921 | Olson | 292/281 |
| 2,629,619 | * | 2/1953 | May | 292/281 |
| 2,698,196 | * | 12/1954 | Mangus | 292/281 |
| 3,572,796 | * | 3/1971 | Willner | 292/281 |
| 4,486,057 | * | 12/1984 | Siwy | 292/281 |
| 4,566,296 | * | 1/1986 | Kochakis | 292/281 |
| 4,852,920 | * | 8/1989 | DeForrest, Sr. | 292/281 |
| 5,462,320 | * | 10/1995 | Davis | 292/285 |

* cited by examiner

*Primary Examiner*—Steven Meyers
*Assistant Examiner*—Teri Pham

(57) ABSTRACT

A locking system comprises a cabinet having unframed swinging glass doors and a hasp for securing the doors in the closed position. The hasp comprises a base plate, a staple plate hingedly secured to the base plate and an L-shaped back plate having a latch staple. A first leg of the back plate and the base plate are mounted to the floor of the cabinet in a juxtaposed position with the back plate positioned on top of the base plate so that the upstanding leg of the back plate acts as a door stop when the doors are closed with the latch staple protruding therebetween. When locking the cabinet, the staple plate is swung about its hinge so as to be positioned parallel to the second leg of the back plate with the latch staple extending through an elongated slot in the staple plate and a padlock is passed through the latch staple to lock the cabinet doors.

1 Claim, 4 Drawing Sheets

GLASP

BACKGROUND OF INVENTION

The field of the invention has various means to increase the security of closures such as cabinet doors against unauthorized openings and the give clear visual indication of any unauthorized movement. It is conventional practice to provide the cabinet of its individual closures with a key or combination lock option. The typical drawbacks of having a unlockable cabinet is tampering without observable signs of unauthorized entry . This present invention has simplicity, ease of use, convenience and visibility of its security. It has a simple design and is easy to apply to cabinets.

SUMMARY OF THE INVENTION

The objective of the invention is to produce a simple inexpensive locking device for hinged cabinet glass doors having no frame to hold a lock. The present invention is directed to security devices and more particularly to an improved hasp construction for use in releasably securing a pair of adjacent door closures in closed condition relative to a closure bounding cabinet's glass doors. The present hasp being equally adapted for used with closures in the form of swinging doors. For cases given wherein less than all of the closures of any given cabinet are required to be afforded extra security if needed with this present invention intended to be secured to an associated cabinet by mounting to the base of the closure and releasably secured shut by means of a padlock or similar.

Another object is to provide a latch construction which is simple, has few parts and is economical and easy to manufacture, yet durable and cannot jam or otherwise readily become inoperable. Still further objective is to provide such a door latch which can be installed easily and quickly by an unskilled person using common tools.

The Glasp would most likely be made from a suitable metal such as stainless steel or brass and would come in the form of two main components. The metal used in each would have thickness of about ⅛". One component would be a rigid "L" (back plate) shape piece about 2 inches high by 1 ½ inches long and one inch wide. The "L" (back plate) shaped piece has slotted holes for adjustment to glass doors of various thickness. The other component of the "Glasp" would have two flat hinge pieces with corresponding holes to match the "L" shaped back plate which is the base design of this apparatus.

This apparatus was invented to fulfill the need for a way to secure the hinged unframed glass doors of a display cabinet or similar item. This invention has simplicity, ease of use, convenience and security. Once installed, however, it would provide a convenient way for a person to secure a display cabinet, etc. The user could easily lock and unlock the cabinet as desired and the product would not interfere with normal opening and closing of the doors in any way.

DETAILED DESCRIPTION OF THE ILLUSTRATED EMBODIMENTS

Figure 1:
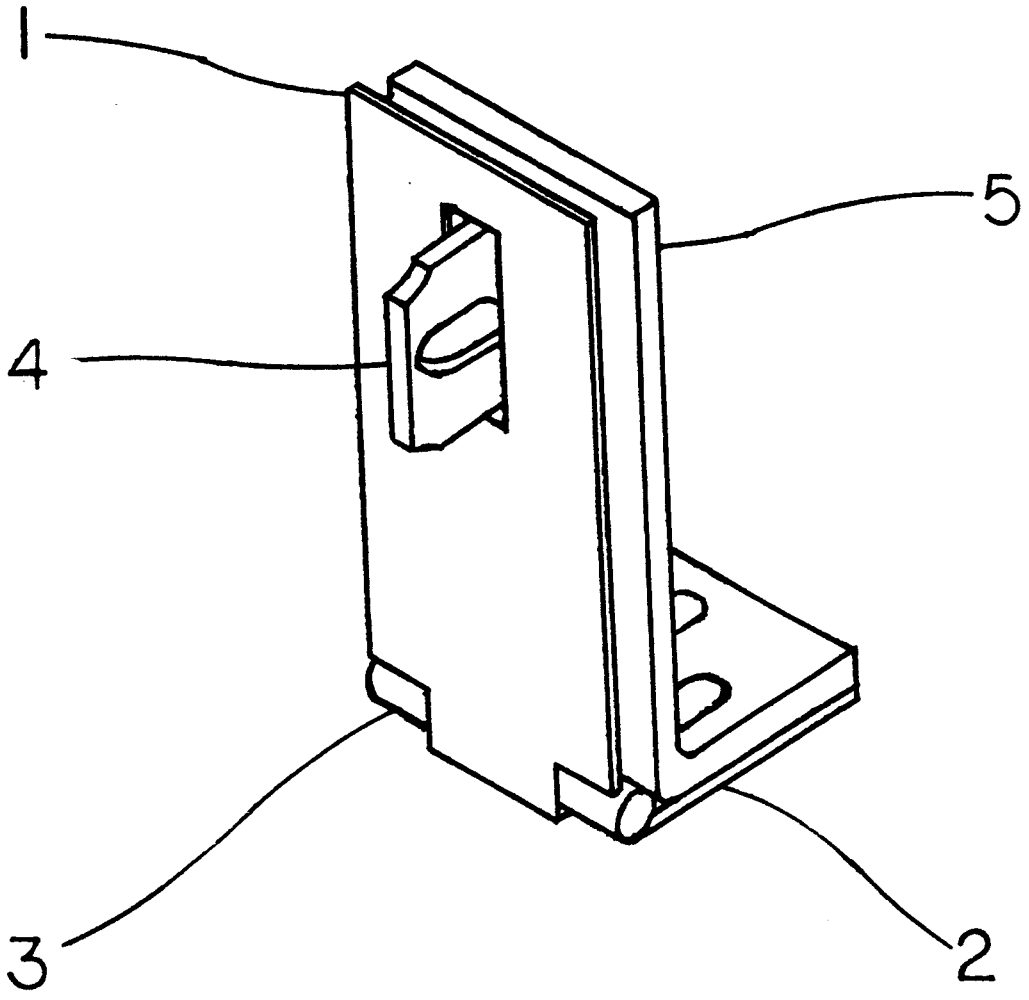
FIG. 1 is a perspective view of a hasp utilizing the hasp staple of the present invention wherein a hinged slotted member is received by the hasp staple mounted to the vertical member of the back plate. The back plate sits on top of the hindge base member, supports all parts, and acts as door stop.

The first illustrated embodiment in FIG. 1 reference No. 1 is the staple plate. This plate is used to keep the doors from opening once they are shut and lock of preference can be placed to attain security. In FIG. 1 reference No. 2 is a part of reference No. 1 when assembled and pinned together by a hinge pin, reference No. 3, on both sides of the parts in mention. References No. 1, the staple plate, No. 2, the base plate, No. 3, the hinge pin and reference No. 4, the latch staple. All of these references described are cut and machined from brass metal or stainless steel for a more pleasant look. Reference No. 4, the latch staple, is designed to clear through the slot in the staple plate, Reference No. 1 in FIG. 1. The staple latch, Reference No. 4 in FIG. 1, is mounted in assembly to the vertical section of the back plate, Reference no. 5 in FIG. 1. This back plate is the strongest part of the device and it sits on top of the base plate, Reference No. 2 in FIG. 1 acting as a door stop. The back plate, Reference No. 5 is the part that adjust to glass door thickness by using slotted holes to move forward or backward. The back plate is made from machined stainless steel or brass with a 90° angle requirement. The staple latch Reference No. 4 in FIG. 1 is mounted to the back plate Reference No. 5 in FIG. 1. The back plate and the staple latch are seamlessly welded together.

Figure 2:
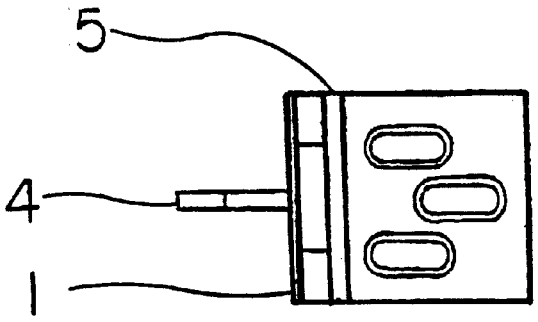
FIG. 2 is a top view of the Glasp where the hinge member is received by the hasp staple that is mounted. The "L" shaped back plate is invention's main support.
Figure 3:
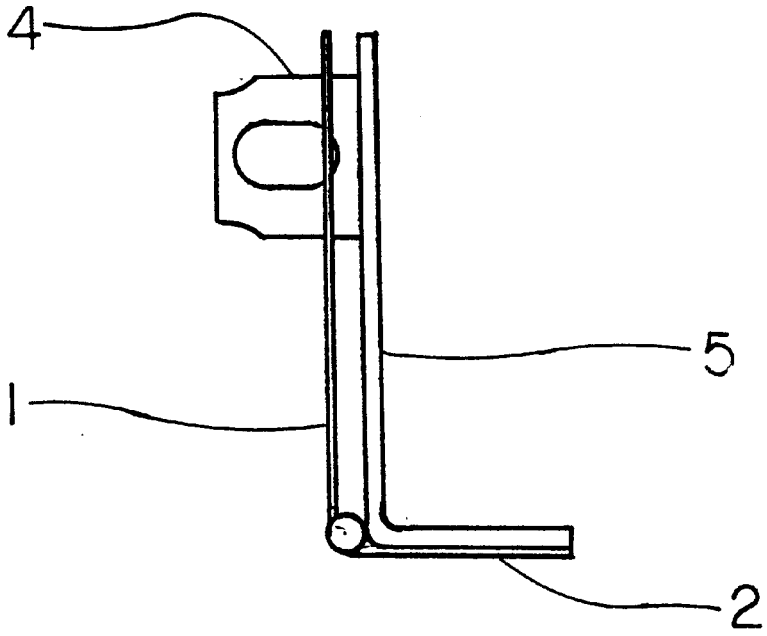
FIG. 3 is a side view elevation of the Glasp device where the hinge member is received by the hasp staple that is mounted to the back plate. In this view you can see the profile of this concept best.
Figure 4:
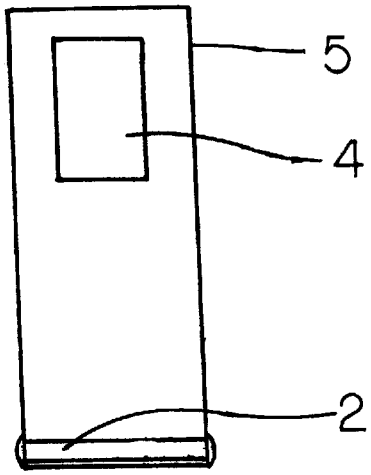
FIG. 4 is the rear view of the Glasp in elevation.
Figure 5:
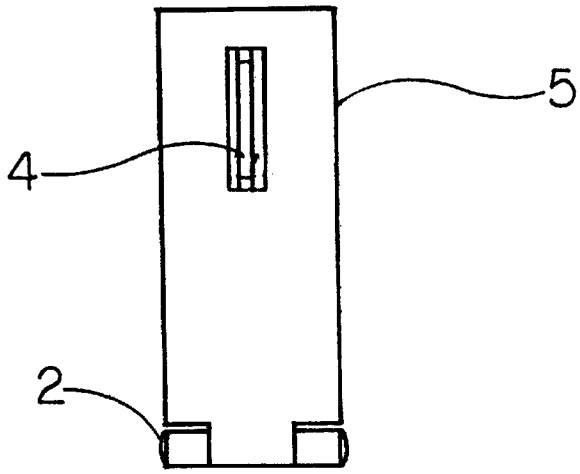
FIG. 5 is the front view of the Glasp in elevation.
Figure 6:
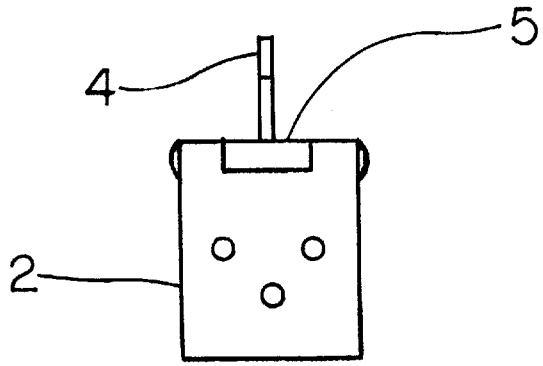
FIG. 6 is the bottom view of the Glasp opposite from the top view where the hinge member is received by the hasp staple that is mounted to the vertical section of the back plate.
Figure 7:
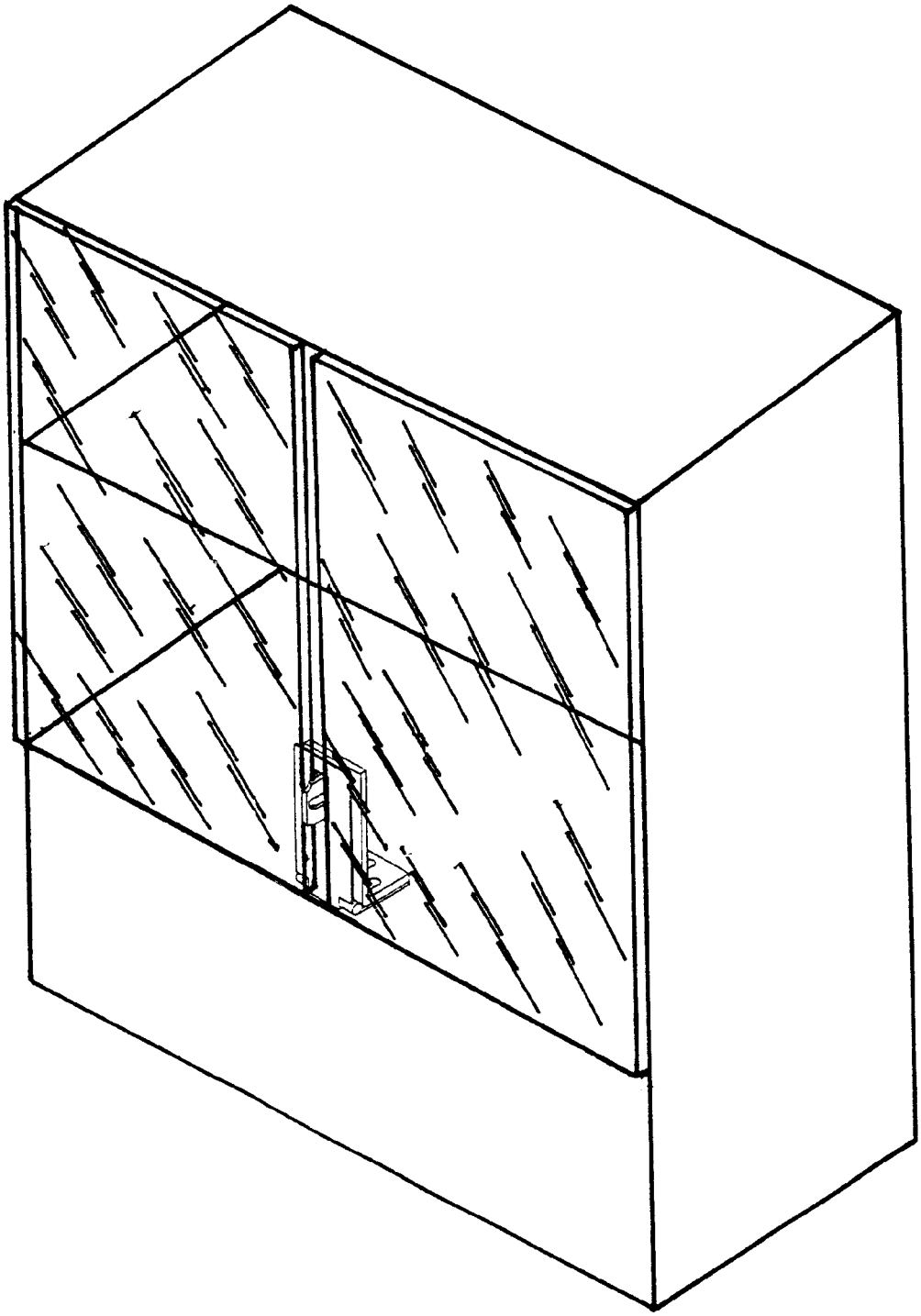
FIG. 7 shows the Glasp mounted on a glass cabinet.

FIG. 2 is a top view of the Glasp. Reference No. 1 in FIG. 2, is the staple plate. In this view you can see the thickness of the latch staple, Reference No. 4 in FIG. 2, as it is completed through the staple plate. Reference No. 5 in FIG. 2 is a top view of the back plate that shows the clearance holes used for adjustment to glass thickness. The back plate holes are machined slotted with screwhead seats in three locations for mounting. FIG. 3 is a side profile of the present invention. In this view of FIG. 3, you can now determined the layout from its side. Reference No. 2 in FIG. 3 shows the base plate with the back plate, Reference No. 5 in FIG. 3, resting on top. Reference 5 in FIG. 3, has slotted holes aligned with holes in the base plate Reference No. 2 in FIG. 3 to receive mounting screws. Both are very supportive to each other. Also in FIG. 3, Reference No. 4, an elongated hole is used to provide adequate clearance for the lock bolt, when adjustment is made for thicker glass. The staple plate, Reference 1 in FIG. 3, will maintain the same vertical position after any adjustment is made. The maximum adjustment of spacing between the back plate, Reference No. 5 in FIG.1 and the staple plate, Reference No. 1 in FIG. 1 is approximately ⅜ inches. The back plate, Reference No. 5 in FIG. 1 is the plate that makes the adjustment when needed. In FIG. 4 this view is a elevation rear view of the back plate, Reference No. 5 in FIG. 4. Also in this you can see the mounting of the parts in assembly of the staple latch, Reference No. 4 in FIG. 4. The staple latch is seamlessly welded to the back plate. Reference No. 2 in FIG. 4 is the horizontal section of the back plate as it sits on the base plate. FIG. 5, is front view of the staple plate showing its clearance of the latch staple, Reference No. 4 in FIG. 5. Reference No. 2 FIG. 5 is the hinge connecting the base and staple plates. Reference No. 5 FIG. 6 is a bottom view of the hinge assembly of base and staple plates and shows the screw holes in the base plate, Reference No. 2 in FIG. 6.

I claim:

1. A locking assembly comprising:

a cabinet having a top wall, a bottom wall, a back wall, side walls and a pair of unframed swinging glass doors pivotally, secured to the side walls;

an L-shaped back plate having a first leg provided with a plurality of elongated holes and a second leg extending perpendicularly from the first leg and provided with a latch staple;

a base plate provided with a plurality of holes aligned with the elongated holes of the back plate;

a staple plate hingedly attached to the base plate and provided with an elongated slot for the receipt of the latch staple;

wherein the first leg of the back plate and the base plate are mounted to the bottom wall of the cabinet in a juxtaposed position with the staple plate positioned on top of the base plate so that the second leg of the back plate acts as a door stop when the doors are closed with the latch staple protruding therebetween and, in locking the cabinet, the staple plate is swung about its hinge so as to be positioned parallel to the second leg of the back plate with the latch staple extending through the elongated slot in the staple plate such that a padlock is adapted to be passed through the latch staple to lock the cabinet doors.

* * * * *